US007084821B2

(12) United States Patent
Noro et al.

(10) Patent No.: US 7,084,821 B2
(45) Date of Patent: Aug. 1, 2006

(54) FIXING STRUCTURE USING A COUPLE OF SCREWS AND ANTENNA UNIT HAVING THE SAME

(75) Inventors: Junichi Noro, Akita (JP); Yuichi Saito, Akita (JP); Kyuichi Sato, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 20 days.

(21) Appl. No.: 10/928,227

(22) Filed: Aug. 27, 2004

(65) Prior Publication Data

US 2005/0074281 A1 Apr. 7, 2005

(30) Foreign Application Priority Data

Oct. 6, 2003 (JP) ..... 2003-347365

(51) Int. Cl.
*H01Q 1/32* (2006.01)

(52) U.S. Cl. ..... 343/713; 343/906; 403/408.1

(58) Field of Classification Search ..... 343/711, 343/712, 713, 714, 715, 716, 717, 906; 403/408.1; H01Q 1/32
See application file for complete search history.

(56) References Cited

U.S. PATENT DOCUMENTS

| | | | | |
|---|---|---|---|---|
| 4,043,205 | A * | 8/1977 | Merlo | 74/5.5 |
| 5,757,327 | A * | 5/1998 | Yajima et al. | 343/713 |
| 6,693,596 | B1 * | 2/2004 | Wakui et al. | 343/711 |
| 6,714,171 | B1 * | 3/2004 | Haussler et al. | 343/888 |

* cited by examiner

*Primary Examiner*—Hoanganh Le
(74) *Attorney, Agent, or Firm*—Frishauf, Holtz, Goodman & Chick, P.C.

(57) ABSTRACT

A fixing hole and a locating hole of an automobile's roof are aligned in a predetermined direction while a fixing part and a locator pin of an antenna unit are aligned in a slightly different direction on the condition the antenna unit is oriented in the predetermined direction. The antenna unit is placed on the roof and a male screw is engaged with a female screw fixed to the fixing part to attach a fixing attachment. By tightening the female screw, the roof is held tight between the antenna unit and the fixing attachment and thereby the antenna unit is fixed to the roof. In this case, the antenna unit is oriented in the predetermined direction with a high degree of accuracy due to clearances between the fixing hole and the fixing part and between the locating hole and the locator pin.

12 Claims, 6 Drawing Sheets

| | FIXING PART | LOCATOR PIN | MINIMUM OFFSET ANGLE |
|---|---|---|---|
| AUTO-MOBILE SIDE | φ 14.55 | φ 3.63 | −2.7° |
| ANTEN-NA SIDE | φ 14.5 | 3.55 × 2.8 | |

| | FIXING PART | LOCATOR PIN | OFFICIAL OFFSET ANGLE |
|---|---|---|---|
| AUTO-MOBILE SIDE | (16.125+14.55)/2 φ 15.338 | (5.205+3.63)/2 φ 4.418 | 0° |
| ANTEN-NA SIDE | φ 14.35 | 3.4 × 2.7 | |

| | FIXING PART | LOCATOR PIN | MAXIMUM OFFSET ANGLE |
|---|---|---|---|
| AUTO-MOBILE SIDE | φ 16.125 | φ 5.205 | +2.8° |
| ANTEN-NA SIDE | φ 14.2 | 3.25 × 2.6 | |

| | FIXING PART | LOCATOR PIN | MINIMUM OFFSET ANGLE |
|---|---|---|---|
| AUTO-MOBILE SIDE | ϕ 14.55 | ϕ 3.63 | +0.7° |
| ANTEN-NA SIDE | ϕ 14.5 | 3.13 | |

| | FIXING PART | LOCATOR PIN | OFFICIAL OFFSET ANGLE |
|---|---|---|---|
| AUTO-MOBILE SIDE | (16.125+14.55)/2 ϕ 15.338 | (5.205+3.63)/2 ϕ 4.418 | +3.5° |
| ANTEN-NA SIDE | ϕ 14.2 | ϕ 3.0 | |

| | FIXING PART | LOCATOR PIN | MAXIMUM OFFSET ANGLE |
|---|---|---|---|
| AUTO-MOBILE SIDE | ϕ 16.125 | ϕ 5.205 | +6.3° |
| ANTEN-NA SIDE | ϕ 13.9 | ϕ 2.87 | |

FIXING STRUCTURE USING A COUPLE OF SCREWS AND ANTENNA UNIT HAVING THE SAME

This application claims priority to prior Japanese patent application JP 2003-347365, the disclosure of which is incorporated herein by reference.

BACKGROUND OF THE INVENTION

This invention relates to a fixing structure for fixing an object to a fixing plate by using a couple of screws, particularly, to a fixing structure for fixing an automobile antenna unit for receiving digital radio broadcasting to an outer plate of an automobile by using a couple of screws, and to the automobile antenna unit having the fixing structure.

Digital radio broadcasting in the United States of America uses a high frequency band such as 2 GHz. Accordingly, a receiving antenna unit for the digital radio broadcasting must be placed out of doors. When a digital radio receiver is mounted on an automobile, an automobile antenna unit for the digital radio receiver must be fixed to an outer plate such as a roof of the automobile.

A related automobile antenna unit has a related fixing structure using first and second screws which can be engaged with each other. The first screw is permanently fixed to the antenna unit while the second screw is not fixed to the antenna unit. The first screw is a nut while the second screw is a bolt, for instance.

The outer plate of the automobile provides a fixing hole to fix the antenna unit. The antenna unit is put on an upside of the outer plate to cover the fixing hole. The second screw is combined with the first screw from an underside of the outer plate to attach a fixing attachment. By tightening the second screw against the first screw, the outer plate is held tight between the antenna unit and the fixing attachment. Thus, the antenna unit is fixed to the outer plate of the automobile.

When the second screw is tightened against the first screw, the antenna unit receives rotating force through the first screw. To prevent the antenna unit rotating, the related fixing structure has a locator pin provided on a bottom of the antenna unit. Correspondingly, a locating hole is provided in the outer plate of the automobile. The fixing hole and the locating hole are aligned in a predetermined direction with respect to the automobile to orient the antenna unit in the predetermined direction. Similarly, the locator pin and the first screw are aligned in the predetermined direction on condition that the antenna unit is oriented in the predetermined direction.

To mount the antenna unit on the outer plate of the automobile, clearance between the locating hole and the locator pin is necessary. However, the clearance allows rotation of the antenna unit when the second thread member is tightened. Accordingly, the related fixing structure has a problem of low accuracy regarding to a direction of the antenna unit.

SUMMARY OF THE INVENTION

It is therefore an object of this invention to provide a fixing structure capable of orienting an object in a predetermined direction with a high degree of accuracy.

Other object of this invention will become clear as the description proceeds.

According to an aspect of this invention, a fixing structure fixes an object to a plate. The fixing structure comprises a first screw provided to the object. A second screw is for engaging with the first screw to fix the object to the plate by the use of a fixing hole provided in the plate. A first locating portion is provided to the object. A second locating portion is provided to the plate and combined with the first locating portion to orient the object in a first direction with respect to the plate. The first screw and the first locating portion are aligned in a second direction different from the first direction on the condition that the object is oriented in the first direction. The second screw and the second locating portion are aligned in the first direction.

According to another aspect of this invention, an antenna unit is fixed to a plate providing a fixing hole and a locating hole which are aligned in a first direction. The antenna unit comprises a case. A first screw is provided to the case. A second screw is for engaging with the first screw to fix the case to the plate by the use of the fixing hole. A locator pin is provided to the case and inserted into the locating hole to orient the case in the first direction. The first screw and the locator pin are aligned in a second direction different from the first direction on the condition that the case is oriented in the first direction.

DESCRIPTION OF THE PREFERRED EMBODIMENT

Referring to FIGS. 1A to 1D, description will be at first directed to a related fixing structure for a better understanding of this invention.

The related fixing structure is used for fixing an object to a fixing plate. For instance, the object is an automobile antenna unit for receiving digital radio broadcasting while a fixing plate is a roof (or an outer plate) of the automobile on which an automobile digital radio receiver is mounted.

Figure 1D:
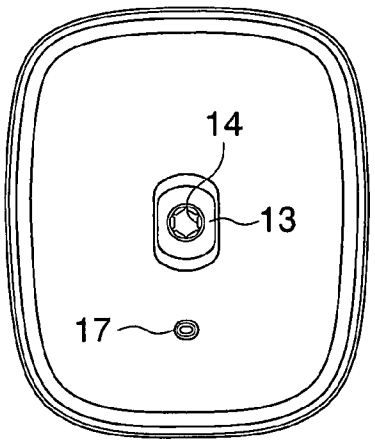
FIG. 1D is a bottom view of the related antenna unit of FIG. 1A.
Figure 1C:
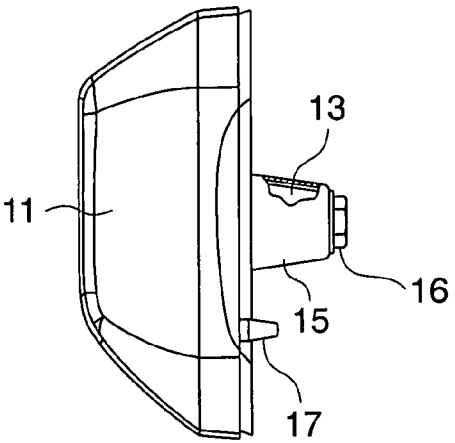
FIG. 1C is a side view of the related antenna unit of FIG. 1A, which a part thereof is cut off.
Figure 1A:
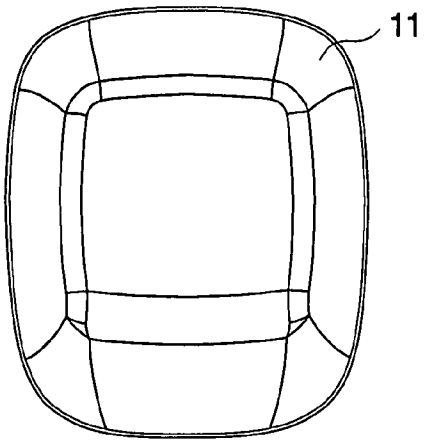
FIG. 1A is a plan view of a related antenna unit having a related fixing structure.
Figure 1B:
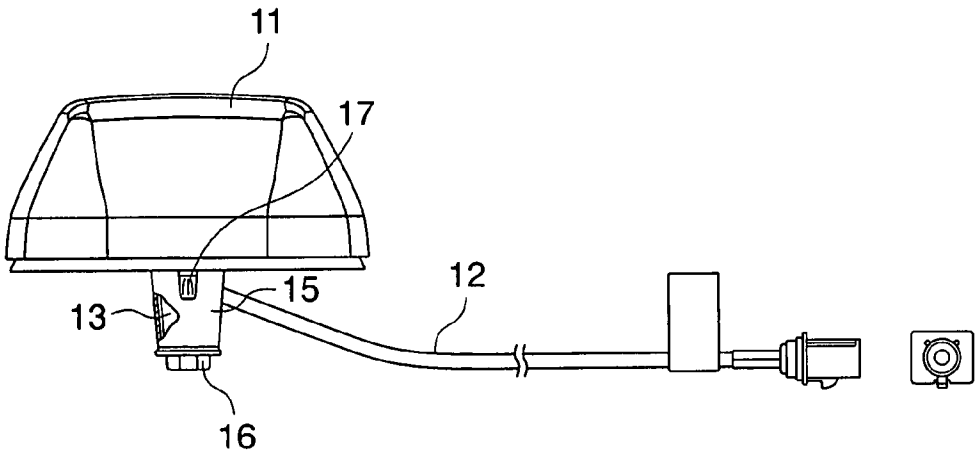
FIG. 1B is a front view of the related antenna unit of FIG. 1A, which a part thereof is cut off, with a cable.
Figure 2D:
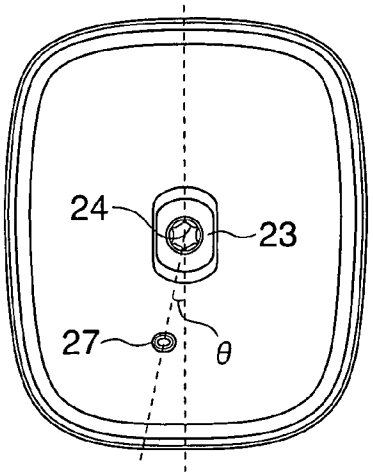
FIG. 2D is a bottom view of the antenna unit of FIG. 2A.
Figure 2C:
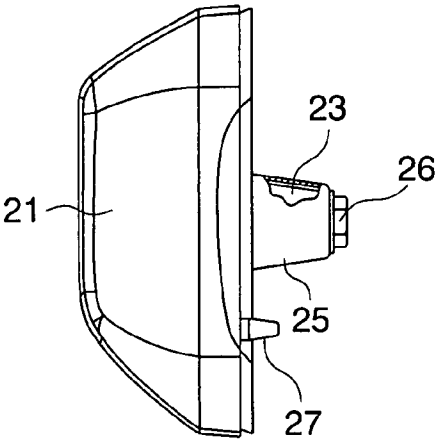
FIG. 2C is a side view of the antenna unit of FIG. 2A, which a part thereof is cut off.
Figure 2A:
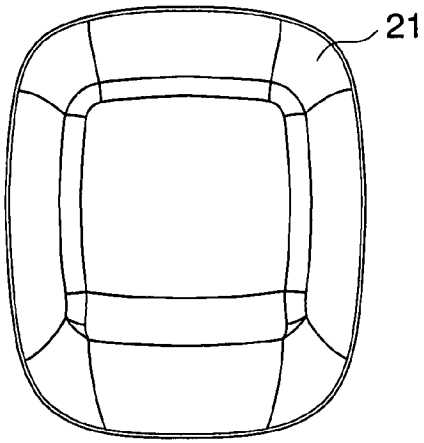
FIG. 2A is a plan view of an antenna unit having a fixing structure according to a preferred embodiment.
Figure 2B:
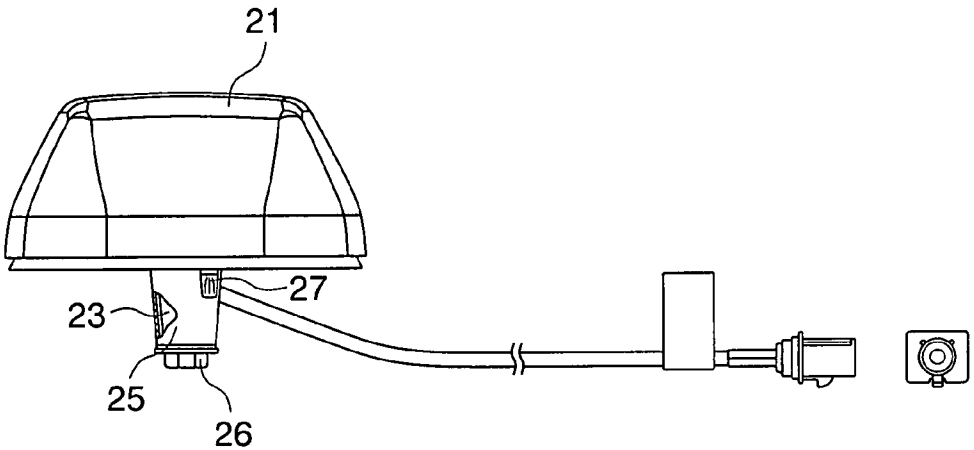
FIG. 2B is a front view of the antenna unit of FIG. 2A, which a part thereof is cut off, with a cable.

As shown in FIGS. 1A to 1D, the automobile antenna unit has a small dome-shaped case 11 to house an antenna element(s) (not shown). A cable 12 (only shown in FIG. 1B) is connected to the antenna element. A fixing part 13 is formed at a center of a bottom (or base) of the case 11 to project. The fixing part 13 is used for not only drawing out the cable 12 from the case 11 to the outside but also fixing the case 11 to a roof of the automobile. A first screw (here, a female screw or a nut) 14 is permanently fixed to the fixing part 13. In FIGS. 1B and 1C, the fixing part 13 is covered with a fixing attachment 15 while the first screw 14 is engaged with a second screw (here, a bolt) 16. In FIG. 1D, the fixing attachment 15 and the second thread member 16 are not shown while a part of a screw thread of the first screw 14 is shown.

To mount the automobile antenna unit on the roof (or an outer panel) of the automobile, a fixing hole corresponding to the fixing part 13 of the antenna unit is formed in the roof of the automobile. The fixing part 13 is inserted into the fixing hole from an upside of the roof. The fixing attachment 15 is attached to the fixing part 13 from an underside of the roof by engaging the second screw 16 with the first screw 14. Thus, a part of the outer panel is held tight between a part of the case 11 and the fixing attachment 15 by tightening up the second screw 16 against the first screw 14, and thereby the antenna unit is fixed to the roof of the automobile.

Here, the automobile antenna unit must be oriented toward a predetermined direction with respect to the automobile. This is because the cable 12 must be drawn out from the case 11 in a prescribed direction, and because it is necessary to suppress influence of wind pressure on the automobile antenna unit, and because it is necessary to prevent wind and rain from coming in an opening formed between the antenna unit and the roof by unconformity of their shape.

To orient the automobile antenna unit in the predetermined direction with respect to the automobile, the related fixing structure includes a locator pin 17 formed on the bottom of the case 11 and a locating hole formed in the outer panel of the automobile to correspond to the locator pin 17. In other words, the related fixing structure is configured so that the antenna unit is oriented in the predetermined direction by insertion of the fixing part 13 and the locator pin 17 into the fixing hole and the locating hole, respectively, when the automobile antenna unit is mounted on the roof of the automobile.

In detail, the fixing hole and the locating hole are aligned in the predetermined direction with respect to the automobile while the fixing part 13 and the locator pin 17 are aligned in the predetermined direction on the condition that the antenna unit is oriented in the predetermined direction with respect to the automobile. In other words, the related fixing structure is constructed so that the antenna unit is oriented toward the predetermined direction when the fixing hole and the fixing part 13 are concentric with each other and the locating hole and the locator pin 17 are concentric with each other.

However, there are clearances between the fixing hole of the automobile and the fixing part 13 of the antenna unit and between the locating hole of the automobile and the locator pin 17 of the antenna unit, respectively. The clearances allow limited rotation of the first screw 14 when the second screw 16 is tightened. That is, the related fixing structure allows limited rotation of the whole of the antenna unit when the second thread member 16 is tightened. Consequently, the antenna unit is fixed to the roof of the automobile in the state that it is oriented toward a different direction that differs a little from the predetermined direction.

Thus, the related fixing structure has a large possibility that the fixed direction of the antenna unit is different from the predetermined direction. In other words, the related fixing structure has a problem of low accuracy regarding to a direction of the antenna unit fixed on the roof of the automobile.

Referring to FIGS. 2A to 2D, the description will proceed to a fixing structure according to a preferred embodiment of this invention.

FIGS. 2A to 2D show an automobile antenna unit which adopts the fixing structure including a couple of screws. The automobile antenna unit has a longitudinal direction along a vertical direction of FIGS. 2A and 2D. Here, it is assumed that the longitudinal direction is a direction to be oriented in a predetermined direction with respect to the automobile when the antenna unit is fixed to the automobile.

The antenna unit illustrated in FIGS. 2A to 2D is similar to the related antenna unit of FIGS. 1A to 1D except a location of a locator pin 27.

In detail, the antenna unit has a case 21 providing a fixing part 23, which projects downward, at a center of a bottom (or base) thereof. As a first screw 24, a female screw is formed in or fixed to the fixing part 23. The locator pin 27 is formed as a first locating portion on the bottom of the case 11. The locator pin 27 is apart from the fixing part 23 and out of a centerline of the longitudinal direction in FIG. 2D. In other words, the fixing part 23 (or the first screw member 24) and the locator pin 27 are aligned in a slant direction at small angles with the centerline. That is, the fixing part 23 and the locator pin 27 are aligned in a different direction slightly different from the predetermined direction with regard to the automobile. For instance, the angle θ between the slant direction and the centerline is equal to about 2 degrees on the condition that a distance between the center of the fixing part 23 and that of the locator pin 27 is equal to about 20 mm. Accurately, the angle θ is decided on the basis of the size of the locator pin 27 and a locating hole as a second locating portion for receiving the locator pin 27. If necessary, the size of the fixing part 23 and the fixing hole for receiving the fixing part 23 is considered to decide the angle θ. That is the angle θ is decided on the basis of the clearance between the locator pin 27 of the antenna unit and the locating hole of the automobile in consideration of the clearance between the fixing part 23 of the antenna unit and the fixing hole of the automobile.

Figure 3:
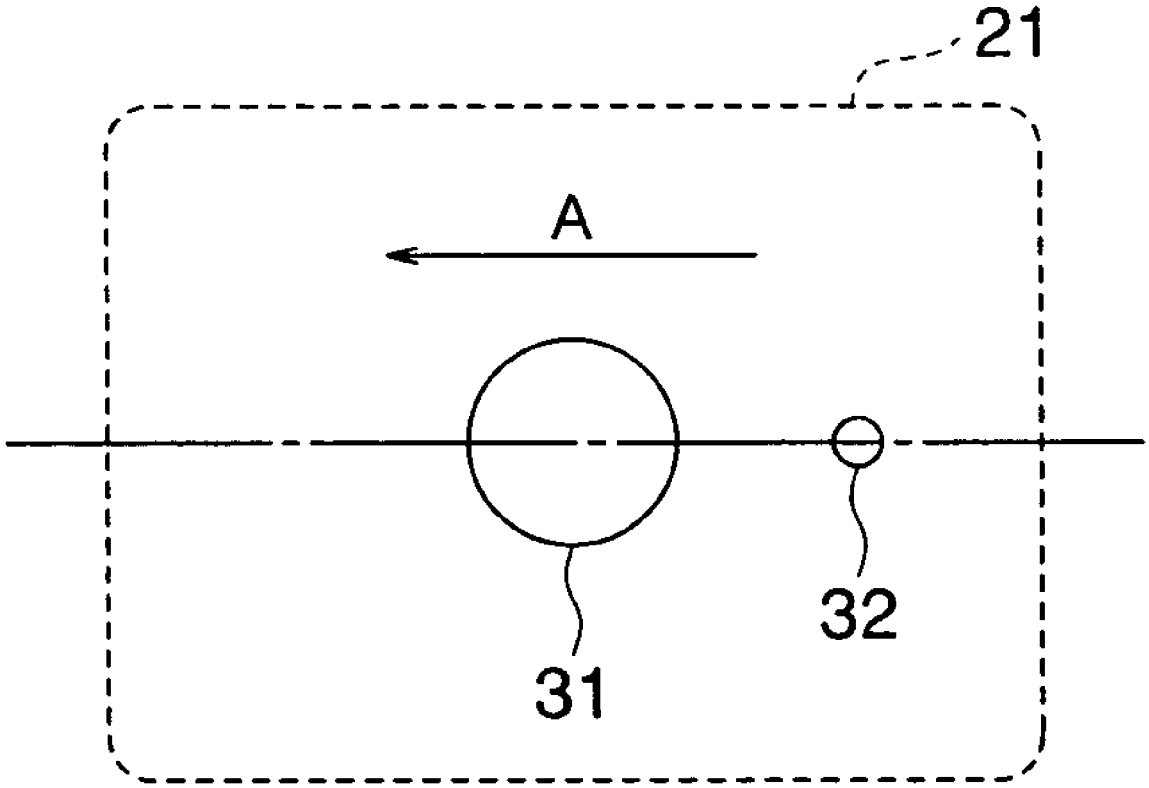
FIG. 3 is plan view for describing a physical relationship between a fixing hole and a locating hole which are formed in a roof of an automobile.

The automobile has a roof (or an outer plate) on which the antenna unit of FIGS. 2A to 2D is mounted. As shown in FIG. 3, a fixing hole 31 and a locating hole 32 are formed in the roof of the automobile and aligned in a predetermined direction A. The fixing hole 31 and the locating hole 32 are used for receiving the fixing part 23 and the locator pin 27, respectively, and for orienting the antenna unit fixed to the roof in the predetermined direction A.

Figure 4:
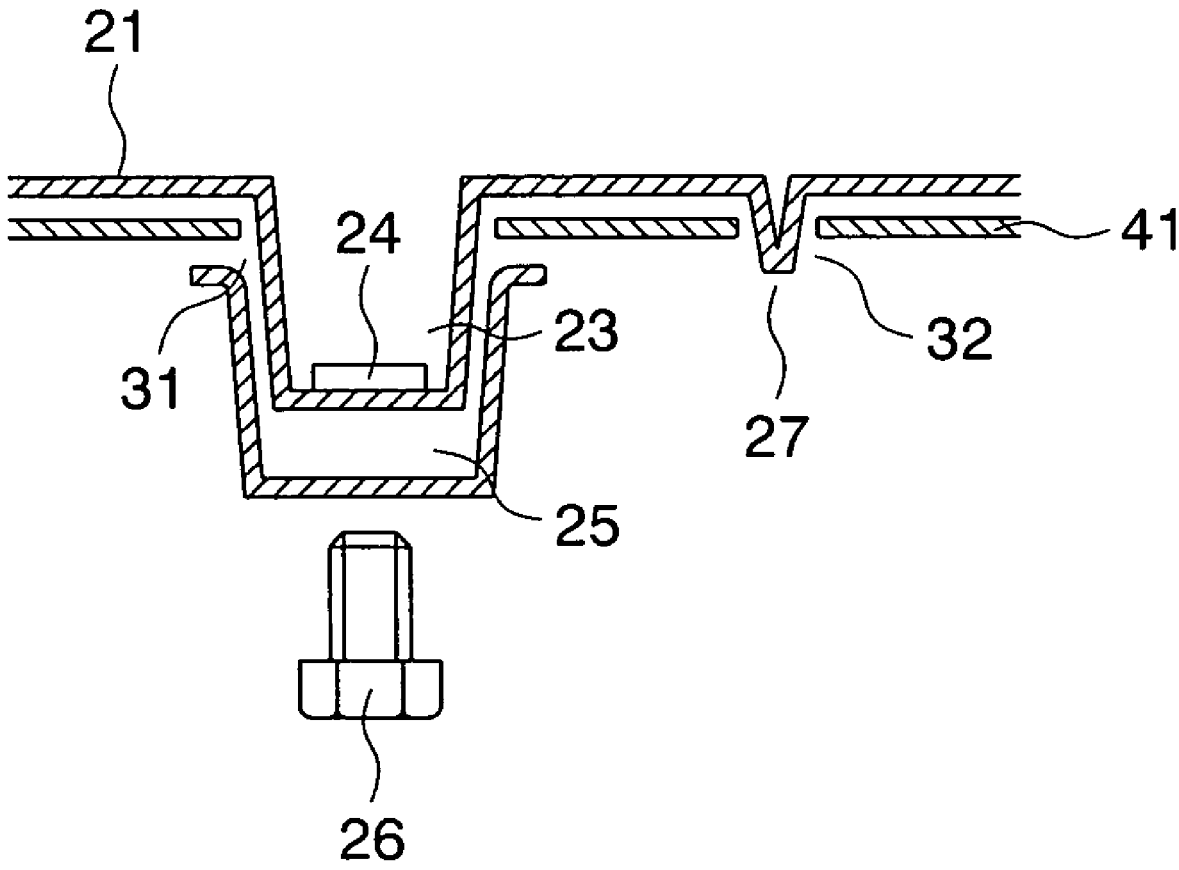
FIG. 4 is a vertical sectional view of the fixing structure according to the preferred embodiment.

The antenna unit of FIG. 2A to 2D is fixed to the roof of the automobile as illustrated in FIG. 4. In detail, the fixing part 23 and the locator pin 27 are inserted into the fixing hole 31 and the locating hole 32, respectively. Furthermore, a fixing attachment 25 is attached to the fixing part 23 from an underside of the roof 41 by the use of a bolt as a second screw 26. With the second screw 26 is tightened, the fixing part 23 and the fixing attachment 25 are moved toward each other. In consequence, an circular edge defining the fixing hole 31 of the outer plate 41 is held tight between a part of the case 21 and the fixing attachment 25, and thereby the antenna unit is fixed to the roof.

Inside measurements of the fixing hole 31 are slightly larger than outside measurements of the fixing part 23. Similarly, inside measurements of the locating hole 32 are slightly larger than outside measurements of the locator pin 27. Thus, there are clearances between the fixing hole 31 and the fixing part 23 and between the locating hole 32 and the locator pin 27, respectively. Furthermore, the fixing part 23, the locator pin 27, the fixing hole 31 and the locating hole 32 have production variations. Therefore, when the second screw 26 is tightened to fix the antenna unit on the roof of the automobile, not only the first screw 24 but also the antenna case 21 is rotated a little.

Figures 5A, 5B, 5C, 5D:
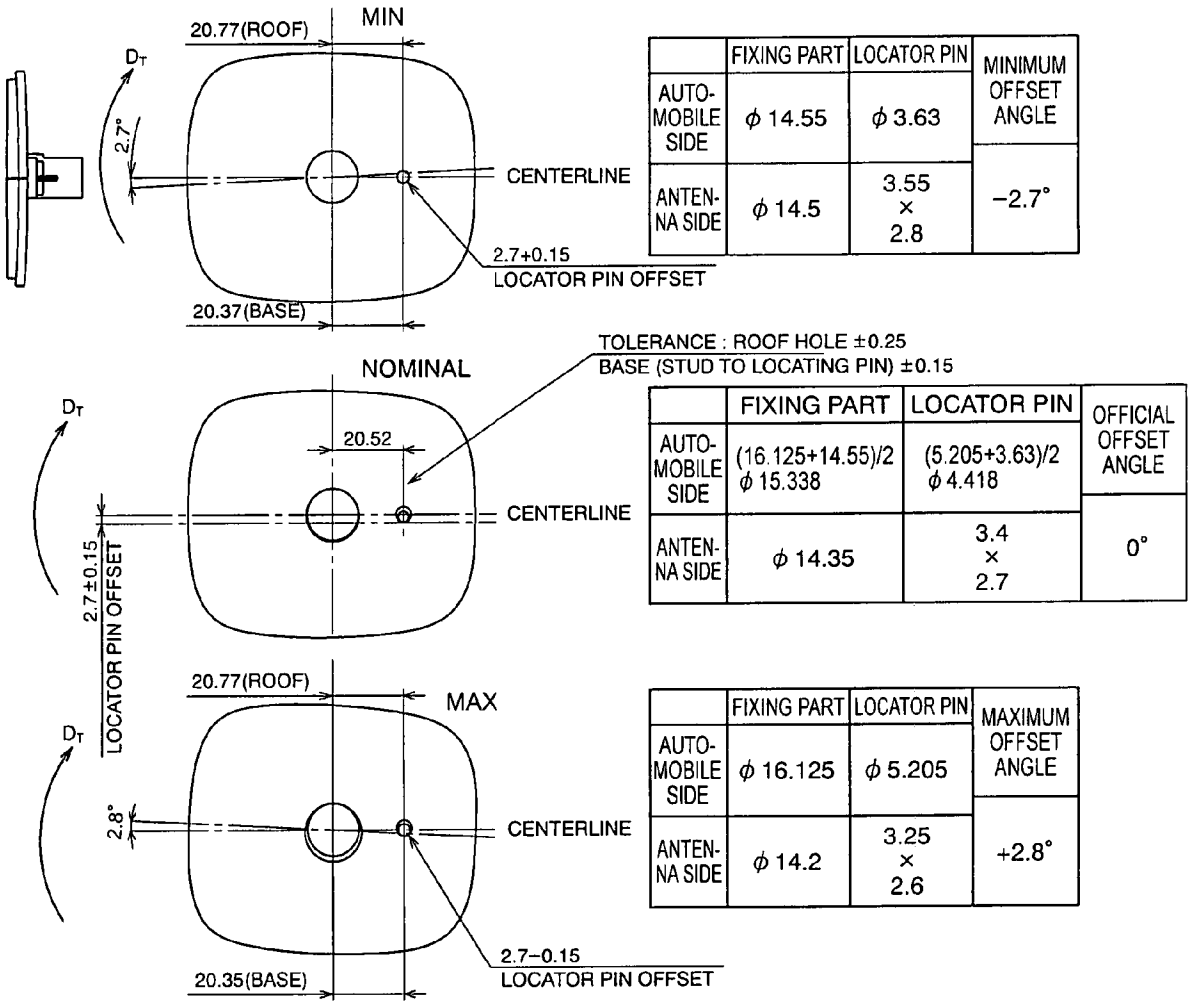
FIGS. 5A–5C are diagrams for describing relationship between production variations of the fixing structure of FIG. 4 and offset angles.
FIG. 5D is a transverse sectional view of a locator pin included in the fixing structure of FIG. 4.

FIGS. 5A to 5C show physical relationship among the fixing hole 31, the locating hole 32, the fixing part 23 and the locator pin 27 after the second screw 26 is tightened by predetermined tightening torque. Here, the locator pin 27 has an oval or ellipse shape as shown in FIG. 5D.

FIG. 5B shows a state that the fixing hole 31 and the locating hole 32 has official inside measurements and that the fixing part 23 and the locator pin 27 have official outside measurements. FIG. 5A shows a state that the fixing hole 31 and the locating hole 32 have the inside measurements equal to the permissible minimum values and that the fixing part 23 and the locator pin 27 have the outside measurements equal to the permissible maximum values. FIG. 5C shows a state that the fixing hole 31 and the locating hole 32 have the inside measurements equal to the permissible maximum values and that the fixing part 23 and the locator pin 27 have the outside measurements equal to the permissible minimum values.

As illustrated in FIG. 5B, the antenna unit is fixed to the roof of the automobile and oriented in the predetermined direction when the fixing hole 31 and the locating hole 32 have the official inside measurements and when the fixing part 23 and the locator pin 27 have the official outside measurements. That is, the offset angle of the antenna unit against the predetermined direction is equal to 0 degree in this case.

On the other hand, when the inside measurements of the fixing hole 31 and the locating hole 32 are smaller than the official inside measurements and when the outside measurements of the fixing part 23 and the locator pin 27 are larger than the official outside measurements, the direction of the antenna unit deviates toward the inverse direction of the tightening direction $D_T$ of the second screw 26 from the predetermined direction because the locator pin 27 is out of the centerline. In the case of FIG. 5A, the offset angle of the antenna unit against the predetermined direction is equal to −2.7 degrees.

Furthermore, when the inside measurements of the fixing hole 31 and the locating hole 32 are larger than the official inside measurements and when the outside measurements of the fixing part 23 and the locator pin 27 are smaller than the official outside measurements, the direction of the antenna unit deviates toward the tightening direction $D_T$ of the second thread member 26 from the predetermined direction. In the case of FIG. 5C, the offset angle of the antenna unit against the predetermined direction is equal to 2.8 degrees.

Thus, the fixing structure according to this embodiment can fix the antenna unit to the roof of the automobile within ±2.8 degrees of the predetermined direction. That is, the fixing structure can orient the antenna unit in the predetermined direction with a high degree of accuracy when the antenna unit is fixed to the roof of the automobile.

Figure 6A:
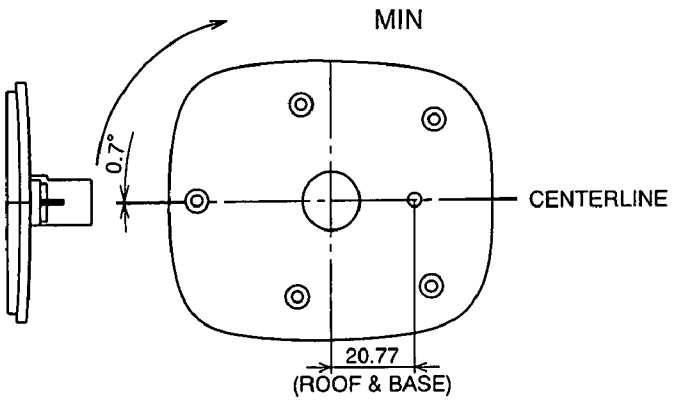
FIGS. 6A–6C are diagrams for describing relationship between production variations of the related fixing structure and offset angles.
Figure 6B:
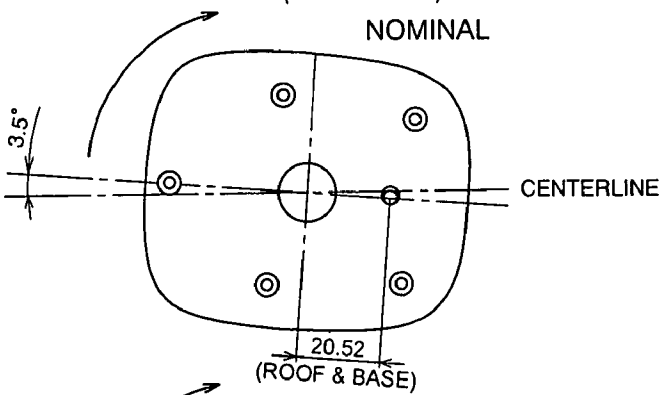
Figure 6C:
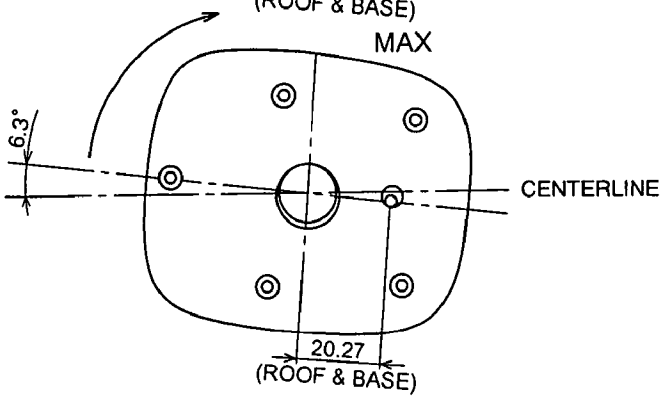

For the comparison, physical relationship among the fixing hole, the locating hole, the fixing part 13 and the locator pin 17 of the related fixing structure is illustrated in FIGS. 6A to 6C. Here, the locator pin 17 is formed on the centerline and has a circular shape.

FIGS. 6A, 6B and 6C are corresponding to FIGS. 5A, 5B and 5C, respectively. That is, FIG. 6B shows a state that the fixing hole and the locating hole have official inside measurements and that the fixing part 13 and the locator pin 17 have official outside measurements. FIG. 6A shows a state that the fixing hole and the locating hole have the inside measurements equal to the permissible minimum values ant that the fixing part 13 and the locator pin 17 have the outside measurements equal to the permissible maximum values. FIG. 6C shows a state that the fixing hole and the locating hole have the inside measurements equal to the permissible maximum values and that the fixing part 13 and the locator pin 17 have the outside measurements equal to the permissible minimum values.

As seen in FIGS. 6A to 6C, the antenna unit is not oriented toward the predetermined direction in each case. That is, the related fixing structure has a deviation of 3.5±2.8 degrees from the predetermined direction. In other words, the related fixing structure can not orient the antenna unit in the predetermined direction with a high degree of accuracy.

By contraries, the antenna fixing structure according to the embodiment can orient the antenna unit in the predetermined direction with a high degree of accuracy when the antenna unit is fixed to the roof of the automobile.

While this invention has thus far been described in conjunction with the preferred embodiment thereof, it will readily be possible for those skilled in the art to put this invention into practice in various other manners.

For example, thought the above description is made about a case where the antenna unit is fixed to the automobile, this invention can be applied to a case where any object different from the antenna unit is fixed to any fixing plate different from the roof of the automobile.

Furthermore, the object to be fixed to the fixing plate may have no fixing part to be inserted in a fixing hole provided in the fixing plate. In this case, a male screw (e.g. a bolt) is inserted into the fixing hole and serves as the fixing part. Additionally, a washer may be used in stead of the fixing attachment in this case. Alternatively, a head of the screw may be used in stead of the fixing attachment.

Still furthermore, the first screw fixed to the object may be a male screw or a bolt. In this case, the second thread member is a female screw or a nut.

At any rate, this invention can be applied to any fixing structure using a couple of screws and a fixing hole formed in the fixing plate to fix the object to the fixing plate.

Moreover, the locator pin may be formed on the fixing plate (e.g. the roof of the automobile). In this case, the locating hole (or a locating cavity) for receiving the locator pin is formed in the object to be fixed to the fixing plate.

In addition, the locator pin may be formed on the centerline of the case of the antenna unit. In this case, the predetermined direction is defined not to be parallel with the centerline. At any late, a first direction, which is defined by a line linking the fixing hole and the locating hole (or the locator pin) on the fixing plate, and a second direction, which is defined by a line linking the fixing part and the locator pin (or locating hole) on the object, only have to be different from each other.

While this invention has thus far been described with reference to the preferred embodiment thereof, it will be readily possible for those skilled in the art to put this invention into practice in various other manners without departing from the scope of this invention.

What is claimed is:

1. A fixing structure for fixing an object to a plate such that a centerline of the object is substantially aligned in a predetermined direction along the plate, said fixing structure comprising:

a first screw provided to said object;

a second screw for engaging with said first screw to fix said object to said plate via a fixing hole provided in said plate;

a first locating portion provided to said object; and a second locating portion which is provided to said plate to define a first direction together with said second screw, and which is engageable with said first locating portion to orient the centerline of said object in the predetermined direction with respect to said plate;

wherein said first screw and said first locating portion are positioned to be aligned in a second direction that is different from and intersects the first direction, when viewed from a bottom side of the object when the centerline is aligned in the predetermined direction.

2. A fixing structure as claimed in claim 1, wherein the second direction is determined based on a clearance between said first locating portion and said second locating portion.

3. A fixing structure as claimed in claim 1, wherein one of said first locating portion and said second locating portion comprises a projecting portion, and the other comprises a receiving portion for receiving said projecting portion.

4. A fixing structure as claimed in claim 1, wherein said first locating portion comprises a projecting portion and said second locating portion comprises a locating hole formed in said plate for receiving said projecting portion.

5. A fixing structure as claimed in claim 1, wherein said object comprises a fixing portion for being inserted into said fixing hole, and said first screw is fixed to said fixing portion.

6. A fixing structure as claimed in claim 5, further comprising a fixing attachment for pressing said plate to said object in accordance with tightening of said second screw against said first screw.

7. A fixing structure as claimed in claim 1, wherein said object comprises an automobile antenna unit and said plate comprises an outer plate of an automobile.

8. An antenna unit to be fixed to a plate, which includes a fixing hole and a locating hole that are aligned in a first direction, said antenna unit comprising:

a case;

a first screw provided to said case;

a second screw for engaging with said first screw to fix said case to said plate via the fixing hole; and a locator pin which is provided to said case to be inserted into the locating hole to orient a centerline of said case substantially in a predetermined direction;

wherein said first screw and said locator pin are positioned to be aligned in a second direction that is different from and intersects the first direction, when viewed from a bottom side of the case when the centerline is oriented in the predetermined direction.

9. An antenna unit as claimed in claim 8, wherein the second direction is determined based on a clearance between the locating hole and said locator pin.

10. An antenna unit as claimed in claim 8, wherein said case comprises a fixing portion for being inserted into the fixing hole, and said first screw is fixed to said fixing portion.

11. An antenna unit as claimed in claim 10, further comprising a fixing attachment for pressing said plate to said case in accordance with tightening of said second screw against said first screw.

12. An antenna unit as claimed in claim 8, wherein said plate comprises an outer plate of an automobile.

* * * * *